United States Patent [19]

Bieberich

[11] 4,129,052

[45] Dec. 12, 1978

[54] WIRE DRAWING DIE AND METHOD OF MAKING THE SAME

[75] Inventor: Paul Bieberich, Fort Wayne, Ind.

[73] Assignee: Fort Wayne Wire Die, Inc., Fort Wayne, Ind.

[21] Appl. No.: 841,885

[22] Filed: Oct. 13, 1977

[51] Int. Cl.[2] ..... B21K 5/20

[52] U.S. Cl. ..... 76/107 A; 72/467

[58] Field of Search ..... 76/107 A, 107 R, 101 B, 76/DIG. 12; 72/467

[56] References Cited

U.S. PATENT DOCUMENTS

| | | | |
|---|---|---|---|
| 2,003,475 | 6/1935 | Shipp | 72/467 |
| 2,171,323 | 8/1939 | Wyland | 76/107 A |
| 3,978,744 | 9/1976 | Zachman | 76/107 A |

*Primary Examiner*—Nicholas P. Godici
*Assistant Examiner*—Roscoe V. Parker
*Attorney, Agent, or Firm*—Gust, Irish, Jeffers & Rickert

[57] ABSTRACT

A wire drawing die employing a synthetic hard, wear-resistant material, such as a polycrystalline aggregate of synthetic diamond or a polycrystalline cubic boron nitride includes a metal casing having flat, parallel front and back sides. A cylindrical cavity is formed in the front casing side having a flat bottom, the side wall of the cavity being undercut adjacent the bottom. A first layer of metal powder is deposited in the casing cavity covering the bottom and the undercut. An annular metal blank having flat opposite sides and a core formed of the hard, wear-resistant material is placed on the first metal powder layer and adhered thereto, the core being concentric with the cavity. A second layer of metal powder is deposited in the cavity covering the first layer and the blank, the metal powder of both layers having a melting point lower than the thermal degradation temperature of the core. A cylindrical cavity having a flat bottom is formed in one end of a cylindrical plug, the inside diameter of the plug cavity adjacent the bottom being greater than that at the one plug end. The plug is inserted in the casing cavity with the plug cavity facing the second metal powder layer until the plug cavity bottom engages the second metal powder layer, and pressure is applied to the plug to compress the metal powder layers. The casing is then heated for a time and at a temperature sufficient to melt the metal powder, but at a temperature less than the thermal degradation temperature of the core thus forming a body of molten metal which encapsulates the blank. The pressure and heating is then terminated and the casing is cooled to solidify the metal body to secure the plug and blank in the casing cavity. Countersunk openings are formed in the back side of the casing and the other end of the plug which respectively extend through the metal body to the core, and a die opening is drilled through the core communicating between the countersunk openings.

12 Claims, 3 Drawing Figures

WIRE DRAWING DIE AND METHOD OF MAKING THE SAME

BACKGROUND OF THE INVENTION

1. Field of the Invention

This invention relates generally to wire drawing dies and methods of making such dies, and more particularly to a wire drawing die employing a synthetic hard, wear-resistant material and the method of making the same.

2. Description of the Prior Art

Natural diamond wire drawing dies have been manufactured for many years and typically comprise a metal casing in which the diamond is mounted, the casing in turn being adpated to be mounted in a wire drawing machine. U.S. Pat. No. 2,171,323 discloses one prior method of making a diamond wire drawing die. In another, more recent method of making a diamond wire drawing die, a flat-bottomed cavity is machined in the casing and a layer of powdered metal is deposited in the cavity, the diamond placed thereon, and additional powdered metal is deposited over the diamond. Powdered metal is then deposited in the cavity of a metal plug which is then inserted in the casing cavity. The casing is then heated, as by induction heat or gas firing and pressure is applied to the plug thereby to solidify the metal powder to encapsulate the diamond. The usual countersunk openings are then machined in the back side of the casing and in the plug and the die opening is drilled through the diamond. U.S. Pat. No. 3,978,744 discloses another more recent method of making natural diamond wire drawing dies.

Polycrystalline aggregates of synthetic diamond have recently become available and an annular sintered tungsten carbide blank having a core or polycrystalline aggregate of synthetic diamond is sold by the General Electric Company under the trademark "Compax". In the past, wire drawing dies employing blanks having polycrystalline aggregate of synthetic diamond cores have been shrink-fitted in the casing; however, such shrink-fitting of the blank has required a substantial amount of skilled labor and has resulted in excessive breakage of the synthetic diamond core. Furthermore, a Compax blank in the form of a segment of a circle has recently become available which, because of its configuration, does not permit such shrink-fitting in the casing. Still further, the General Electric Company has even more recently introduced another synthetic hard, wear-resistant material suitable for use in wire drawing dies, that material being polycrystalline cubic boron nitride sold under the trademark Borazon. It is therefore desirable to provide a wire drawing die employing a synthetic hard, wear-resistant material, and a method of making the same, which eliminates shrink-fitting of the blank in the casing and reduces breakage of the core.

SUMMARY OF THE INVENTION

In accordance with the method of the invention, in its broader aspects, a metal casing is provided, a cylindrical cavity is formed in the front casing side which has a bottom spaced from the back casing side, and the side wall of the cavity is undercutted adjacent the bottom. A first layer of metal powder is deposited in the casing covering the bottom, a metal blank having a core formed of a synthetic hard, wear-resistant material is placed on the first layer with the core concentric with the cavity, and a second layer of metal powder is deposited in the cavity covering the first layer and the blank, the metal powder of both layers having a melting point lower than the thermal degradation temperature of the core. A cylindrical plug is provided having opposite ends and with its outside diameter so related to the inside diameter of the casing cavity as to provide a close slip fit therein. A cylindrical cavity is formed in one end of the plug having a bottom spaced from the other plug end, the inside diameter of the plug cavity adjacent the bottom thereof being greater than at the one plug end. The plug is inserted in the casing cavity with the plug cavity facing the second metal powder layer until the plug cavity bottom engages the second layer. Pressure is applied to the other end of the plug thereby to compress the metal powder layers, and the casing is heated for a time and at a temperature sufficient to melt the metal powder but at a temperature less than the thermal degradation temperature of the core thus forming a body of molten metal which encapsulates the blank. The pressure and heating is terminated and the casing is cooled to solidify the metal body thereby to secure the plug and blank in the casing cavity. Countersunk openings are formed in the back side of the casing and the other end of the plug which respectively extend through the metal body to the core, and a die opening is drilled through the core communicating between the countersunk openings.

It is accordingly an object of the invention to provide an improved method of making a wire drawing die.

Another object of the invention is to provide an improved wire drawing die.

A further object of the invention is to provide an improved method of making a wire drawing die employing a synthetic, hard, wear-resistant material, such as polycrystalline aggregate of synthetic diamond or a polycrystalline cubic boron nitride.

Yet another object of the invention is to provide an improved wire drawing die employing a synthetic, hard, wear-resistant material, such as polycrystalline aggregate of synthetic diamond or a polycrystalline cubic boron nitride.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 3:
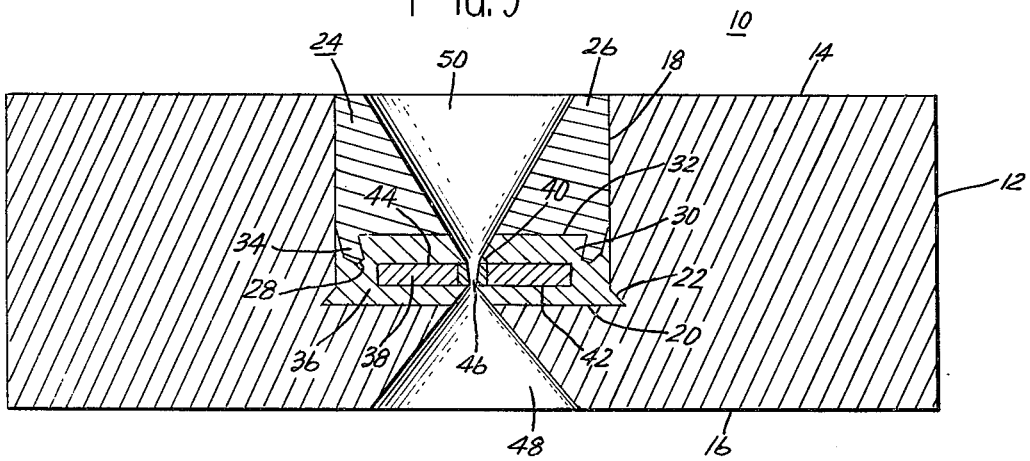
FIG. 3 is a cross-sectional view showing the finished wire drawing die of the invention.

Referring first to FIG. 3 of the drawing, the improved wire drawing die of the invention, generally indicated at 10, comprises a cylindrical metal casing 12, preferably, but not necessarily, formed of stainless steel, having flat, parallel, front and back sides 14, 16. Cylindrical cavity 18 is formed in front side 14 of casing 12 and has flat bottom 20 spaced from and parallel with back side 16. The side wall of cavity 18 is undercut adjacent bottom 20, as at 22.

Cylindrical plug 24 having top and bottom ends 26, 28 is closely fitted in cavity 18 with its bottom end 28 spaced from bottom 20. Plug 24 has cavity 30 formed in its bottom end 28 having flat bottom 32 parallel with bottom 20 of cavity 18. Cavity 30 in plug 24 defines annular flange 34 which is inclined inwardly away from the side wall of cavity 18 so that the inside diameter of cavity 30 is greater at its bottom 32 than at bottom end 28 of plug 24.

Figure 2:
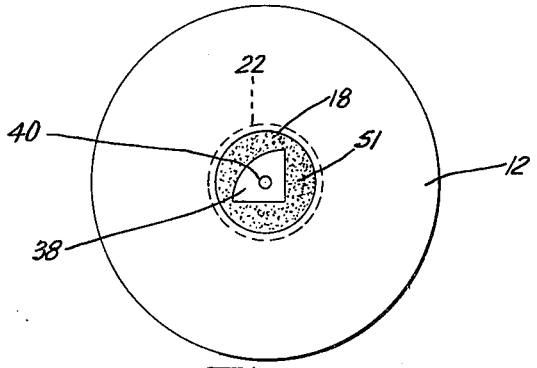
FIG. 2 is a top view taken generally along the line 2—2 of FIG. 1 but before insertion of the plug in the casing cavity.

The cavity defined between bottom 20 of casing cavity 18 and bottom 32 of plug cavity 30 is filled with body 36 of solidifed metal which encapsulates blank 38 and secures plug 24 in cavity 18 by virtue of the inwardly inclined annular flange 34 thereon. In the illustrated embodiment, blank 38 forms a segment of a circle, as shown in FIG. 2, and may be of the type sold by the General Electric Company under the trademark Compax. Blank 38 is typically formed of sintered tungsten carbide and has core 40 therein formed of polycrystalline aggregate of synthetic, i.e., man-made diamond. Alternatively, core 40 may be formed of polycrystalline cubic boron nitride. Blank 38 encapsulated in metal body 36 is spaced from bottom 20 of casing cavity 18 and bottom 32 of plug cavity 30 and has flat surfaces 42, 44 respectively parallel with cavity bottoms 20, 32. Core 40 has die opening 46 therethrough concentric with cavity 18. The usual countersunk openings 48, 50 are formed in back side 16 of casing 12 and end 26 of plug 24 and respectively extend through metal body 36 to core 40 to communicate with die opening 46.

In one specific embodiment of the wire drawing die shown in FIG. 3 and described above, casing 12 has a diameter of 1⅛ inch and a thickness of 0.0360 inch. Cavity 18 has a depth of 0.260 inch and an inside diameter of 0.312 inch. The inside diameter of cavity 30 of plug 24 at bottom 32 is 0.262 inch and the depth of cavity 30 is 0.050 inch. Bottom 32 of plug 24 is spaced from bottom 20 of cavity 18 by about 0.125 inch.

Figure 1:
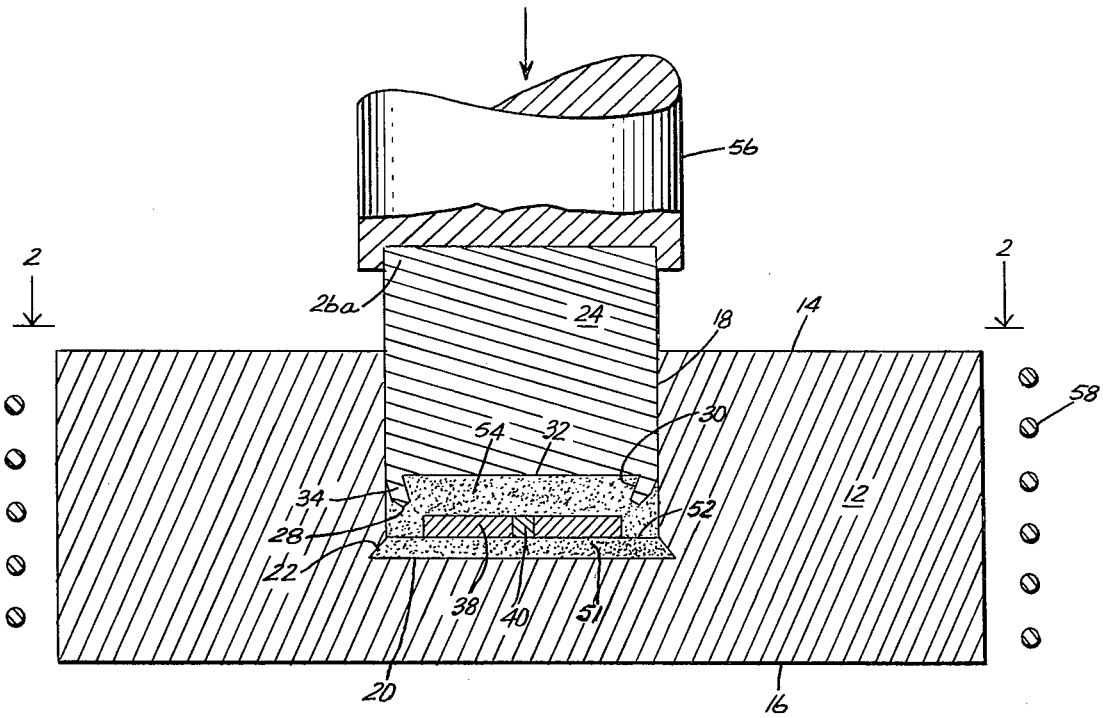
FIG. 1 is a cross-sectional view illustrating the method of the invention.

Referring now to FIGS. 1 and 2 of the drawings, in the method of making wire drawing die 10, cylindrical cavity 18 is machined in front side 14 of casing 12, as with a screw machine, and undercut 22 is machined, as with a lathe. Layer 52 of suitable metal powder, to be hereinafter described, is then deposited in cavity 18 covering bottom 20 to a level slightly above undercut 22 and slight pressure is applied on layer 51 with a plane plunger (not shown) so that top surface 52 is plane and parallel with cavity bottom 20. Blank 38 having core 40 therein is then placed on top surface 52 of layer 51 and adhered thereto by a suitable adhesive, such as sodium silicate, which will vaporize under high temperature. Blank 38 is located so that core 40 is concentric with cylindrical cavity 18.

A second layer 54 of metal powder is then deposited in cavity 18 to cover blank 38 to a depth of about 0.060 inch. The metal powder of which both layers 51, 54 is formed has a melting point slightly less than the thermal degradation temperature of the core 40, i.e., slightly less than about 1200° F. in the case of a core 40 formed of a polycrystalline aggregate of synthetic diamond. A metal powder composed of, by weight:

45% cu
45% ni
10% Easy-Flow 45 brazing alloy, which is composed of:
45% ag
15% cu
16% zn
24% cd which has a melting point of 1125° F. has been found to be suitable for the purpose.

Plug 24 is machined from suitable metal, such as stainless steel, and has an initial length greater than in the finished die. The outside diameter of plug 24 is so related to the inside diameter of cavity 18 as to provide a close slip fit. Cavity 30 is machined in end 28 of plug 24 so as to provide the inwardly inclined annular flange 34.

Plug 24 is then inserted in cavity 18 and casing 12 until bottom 32 of cavity 30 engages powder metal layer 54 and pressure, which may be on the order of 800 p.s.i. gauge, is applied on end 26*a* of plug 24, as by ram 56, thereby to compress powder metal layers 51, 54. Casing 12 is then heated, as by being placed within induction heating coil 58, the temperature being brought up slowly to a level sufficient to melt the metal powder but not to exceed 1200° F. In the specific embodiment described, a heating time of about one minute is sufficient to melt the powder metal layers 51, 54 to form molten metal body 36 encapsulating blank 38. Following termination of the heating, the pressure is maintained for an additional short period of time, such as about thirty seconds in the specific embodiment described, in order sufficiently to solidify metal body 36 to secure plug 24.

Following further cooling of casing 12 and plug 24, end 26*a* of plug 24 is machined so as to be flush with front side 14 of casing 12, as shown in FIG. 3. Countersunk openings 48, 50 are then machined following which, core 40 is drilled to form die opening 46.

While the invention has been described in connection with use of die blank 38 which is a segment of a circle, it will be readily understood that an annular die blank may be employed. It will further be understood that while a specific metal powder composition is described, other metal powders may be employed so long as the melting point does not exceed the thermal degradation temperature of the core 40, the pressure and temperature, and the time of application of pressure and temperature in part depending upon the specific metal powder used.

While there have been described above the principles of this invention in connection with specific apparatus, it is to be clearly understood that this description is made only by way of example and not as a limitation to the scope of the invention.

What is claimed is:

1. The method of making a wire drawing die comprising the steps of: providing a metal casing having front and back sides; forming a cylindrical cavity in said front casing side having a bottom spaced from said back casing side, and undercutting the side wall of said cavity adjacent said bottom; depositing a first layer of metal powder in said cavity covering said bottom; placing on said first layer a metal blank having a core formed of a synthetic hard wear-resistant material with said core concentric with said cavity; depositing a second layer of metal powder in said cavity covering said first layer and blank; said metal powder having a melting point lower than the thermal degradation temperature of said core; providing a cylindrical plug having opposite ends and its outside diameter so related to the inside diameter of said casing cavity as to provide a close slip fit, forming a cylindrical cavity in one of said plug ends having a bottom spaced from said other end, the inside diameter of said plug cavity adjacent said bottom thereof being greater than at said one plug end; inserting said plug in said casing cavity with said plug cavity facing said second metal powder layer until said plug cavity bottom engages said second layer; applying pressure to said other end of said plug thereby to compress said first and second metal powder layers, and heating said casing while maintaining said pressure for a time and at a temperature sufficient to melt said metal powder, but at a temperature less than the thermal degradation temperature of said core, thereby to form a body of molten metal encapsulating said blank; terminating said pressure and heating and cooling said casing to solidify said metal body thereby to secure said plug and blank in said casing cavity; forming countersunk openings in said back side of said casing and said other end of said plug which respectively extend through said metal body to said core; and drilling a die opening through said core communicating between said countersunk openings.

2. The method of claim 1 wherein said casing sides are substantially flat and parallel, said first metal powder layer being deeper than the height of said undercut and filling the same, and comprising the further step of smoothing the top surface of said first layer prior to placing said blank therein so that said top surface is level and parallel with said back casing side.

3. The method of claim 2 wherein said blank is adhered to said top surface of said first metal powder layer.

4. The method of claim 3 wherein said casing cavity bottom and plug cavity bottom are flat and parallel with said back casing side.

5. The method of claim 4 wherein said plug cavity defines an annular flange with the side wall thereof and which is inclined inwardly away from the wall of said casing cavity.

6. The method of claim 4 wherein said blank is a segment of a circle with substantially flat, parallel opposite sides, one of said blank sides being adhered to said top surface of said first layer.

7. The method of claim 1 wherein said synthetic material is chosen from the group consisting of a polycrystalline aggregate of synthetic diamond and a polycrystalline cubic boron nitride.

8. A wire drawing die comprising: a metal casing having front and back sides, said front casing side having a cylindrical cavity formed therein, said casing cavity having a bottom spaced from said back casing side and having its side wall undercut adjacent said bottom; a cylindrical plug closely fitted in said casing cavity and having opposite ends; one of said plug ends facing and being spaced from said cavity bottom, said one plug end having a cylindrical cavity formed therein, said plug cavity having a bottom spaced from said other plug end, the inside diameter of said plug cavity adjacent said bottom being greater than that at said one end, said plug cavity bottom being spaced from said casing cavity bottom thereby defining another cavity therebetween which includes said undercut; a body of metal solidified filling said other cavity thereby securing said plug in said casing cavity; and a metal blank having a core formed of synthetic hard, wear-resistant material encapsulated in said metal body with said core concentric with said casing cavity; said back side of said casing and said other end of said plug having countersunk openings therein respectively extending therethrough and through said metal body to said core, said core having a die opening therethrough communicating between said countersunk openings.

9. The die of claim 8 wherein said casing has substantially flat, parallel sides, said blank and core having substantially flat, parallel opposite sides respectively parallel with said casing sides.

10. The die of claim 9 wherein said blank is a segment of a circle.

11. The die of claim 9 wherein said plug cavity defines an annular flange with the side wall thereof and which is inclined inwardly away from said casing cavity side wall.

12. The die of claim 8 wherein said synthetic material is chosen from the group consisting of a polycrystalline aggregate of synthetic diamond and a polycrystalline cubic boron nitride.

* * * * *

UNITED STATES PATENT AND TRADEMARK OFFICE

CERTIFICATE OF CORRECTION

PATENT NO. : 4,129,052

DATED : December 12, 1978

INVENTOR(S) : Paul Bieberich

It is certified that error appears in the above-identified patent and that said Letters Patent are hereby corrected as shown below:

Column 1, line 35, "or" should be -- of --.

Column 3, line 33, "0.0360" should be -- 0.360 --.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*